US008162186B2

(12) United States Patent
Maxwell

(10) Patent No.: US 8,162,186 B2
(45) Date of Patent: Apr. 24, 2012

(54) VALVE TOP

(75) Inventor: Charles P. Maxwell, Mequon, WI (US)

(73) Assignee: Tablecraft Products Company, Gurnee, IL (US)

( * ) Notice: Subject to any disclaimer, the term of this patent is extended or adjusted under 35 U.S.C. 154(b) by 803 days.

(21) Appl. No.: 12/120,279

(22) Filed: May 14, 2008

(65) Prior Publication Data

US 2009/0283555 A1 Nov. 19, 2009

(51) Int. Cl.
*B65D 5/72* (2006.01)

(52) U.S. Cl. ..... 222/494; 222/212; 222/213; 222/490

(58) Field of Classification Search ..... 222/181.1, 222/185.1, 209, 213–215, 206, 494, 490–493, 222/212
See application file for complete search history.

(56) References Cited

U.S. PATENT DOCUMENTS

| | | | | | |
|---|---|---|---|---|---|
| 1,683,727 | A | * | 9/1928 | Rose | 222/490 |
| 3,884,396 | A | * | 5/1975 | Gordon et al. | 222/327 |
| 4,356,935 | A | * | 11/1982 | Kamin | 222/1 |
| 4,432,473 | A | * | 2/1984 | MacEwen | 222/327 |
| 4,961,888 | A | | 10/1990 | Brown | |
| 4,991,745 | A | | 2/1991 | Brown | |
| 5,033,655 | A | | 7/1991 | Brown | |
| 5,213,236 | A | | 5/1993 | Brown et al. | |
| 5,271,531 | A | | 12/1993 | Rohr et al. | |
| 5,339,995 | A | | 8/1994 | Brown et al. | |
| 5,377,877 | A | | 1/1995 | Brown et al. | |
| 5,409,144 | A | | 4/1995 | Brown | |
| 5,439,143 | A | | 8/1995 | Brown et al. | |
| 5,626,262 | A | * | 5/1997 | Fitten et al. | 222/184 |
| 5,676,289 | A | | 10/1997 | Gross et al. | |
| 6,230,940 | B1 | | 5/2001 | Manning et al. | |
| 6,293,437 | B1 | * | 9/2001 | Socier et al. | 222/212 |
| 6,530,504 | B2 | * | 3/2003 | Socier | 222/494 |
| 6,655,554 | B2 | * | 12/2003 | Pantelleria et al. | 222/327 |
| 6,938,805 | B2 | * | 9/2005 | Brincat | 222/568 |
| 6,951,295 | B1 | * | 10/2005 | Gaus et al. | 222/484 |
| 7,128,245 | B2 | * | 10/2006 | Lee | 222/212 |
| 7,699,193 | B2 | * | 4/2010 | Feierabend | 222/494 |
| 7,784,652 | B2 | * | 8/2010 | Gaus et al. | 222/494 |
| 2008/0110938 | A1 | * | 5/2008 | Sternberg | 222/494 |
| 2009/0127294 | A1 | * | 5/2009 | Krallmann | 222/494 |

* cited by examiner

*Primary Examiner* — Frederick C. Nicolas
(74) *Attorney, Agent, or Firm* — Pearne & Gordon LLP

(57) ABSTRACT

A refillable bottom dispensing package forming a closed space in which fluid material can be stored and from which such material can be dispensed, the package having a rigid wall adjacent a bottom thereof, the wall having a hole, a resilient valve regulating dispensing of the fluid material contained in the package through the hole, the valve being closed to the passage of fluid material through the hole when the contents of the package are substantially at atmospheric pressure and being opened by pressure on the contents when the pressure is above atmospheric pressure, the valve forming a flap seal against a surface of the wall, the sealing action of the flap seal against the wall surface being free of influence from structural elements of the package while being directly responsive in its sealing force against the wall surface to the pressure level of the contents in the package space, the interrelationship of the flap seal and the wall within the package being arranged to avoid impeding removal of the valve from the wall and the package.

14 Claims, 2 Drawing Sheets

VALVE TOP

BACKGROUND OF THE INVENTION

The invention relates to hand-held fluid dispensing devices.

PRIOR ART

Squeeze bottles and like containers are ordinarily used to dispense flowable materials or fluids such as liquids, pastes, fluidized powders, and the like. Increasingly popular are bottom dispensing packages of rigid, semi-rigid, or flexible containers or bottles of the type that can be squeezed or otherwise pressurized to express the fluid product therein. These bottom dispensing packages are very convenient in use, particularly with viscous materials, since such materials continually rest on the bottom of the package in fluid communication with a dispensing valve. This condition avoids the annoying and time consuming need to shake or jar the container to bring the contents to the dispensing valve as would be required where the package dispensed from its top. As a point of reference, the top of a package can be considered its uppermost portion when the package is stored.

Bottom dispensing containers are now commonly used for dispensing fluid foodstuff. Refilling a container with foodstuff, a common practice in the food service industry where goods are purchased in bulk, can be problematic with reference to the ease with which the package can be sanitized. This problem of cleanability can be more acute in bottom dispensing packages. Certain known types of dispensing valves suitable for bottom dispensing packages, such as disclosed in U.S. Pat. Nos. 5,213,236, and 5,409,144 do not lend themselves to be readily cleaned. Accepted good health practices require that a bottle or other package be thoroughly and completely cleaned before each time it is refilled to assure that the risk of bacteria growth is effectively eliminated.

SUMMARY OF THE INVENTION

The invention provides an improved bottom dispensing package particularly suited for refilling with fluid foodstuffs by virtue of being readily and completely disassemblable for sanitizing before refilling. The illustrated package includes an elastomeric dispensing valve having a novel integral flap seal structure that effects a seal between it and a host part of the package on which the valve is located. The flap seal contacts an interior rigid wall area of the package forming a boundary surrounding an aperture through which contents of the package are dispensed. The nature of the flap seal is such that its sealing contact pressure advantageously is directly related to the pressure of the contents in the package. Still further, the flap seal can provide a convenient finger grip to be used for extracting the valve from its operative position on the package wall to enable it to be easily sanitized.

The disclosed valve body structure avoids the necessity of separate retainer elements or secondary operations on the package wall to hold and seal it in position. The self-holding and self-sealing action of the valve avoids tedious and time-consuming disassembly and reassembly effort of the valve body on the package wall and eliminates the risk that such elements would be improperly assembled, broken or lost and avoids any need to sanitize them.

In the disclosed embodiment of the invention, the dispensing package is in the form of a cylindrical hand-held squeeze bottle. The mouth of the bottle is relatively large, comparable with the diameter of the bottle itself, and is threaded with a unique thread form making it easy to clean. The bottle is closed by a cap or closure having threads complementary to the shape of the bottle threads. The overall configuration of the closure is similar to a conventional screw-on cap, with the closure having a skirt providing internal thread surfaces proportioned to screw onto the outside of a threaded neck of the bottle. An end wall of the closure integrally molded with the skirt has a round through hole for receiving parts of the valve body. The valve body, a circular flexible elastomeric element, is received in the end wall hole from the inside of the closure. The flap seal of the valve body is an annular element concentric with other body portions and having a radial extent from an inside diameter to an outside diameter that exceeds at least about five times the wall thickness of the flap seal, thereby assuring a compliant and therefor effective seal. An outer edge of the flap seal is effectively free of overlying restraining structure giving it freedom to self-seat against the opposed rigid package wall formed by the closure end wall and making it easily and quickly manually separable from this end wall for cleaning purposes.

DESCRIPTION OF THE PREFERRED EMBODIMENT

Figure 1:
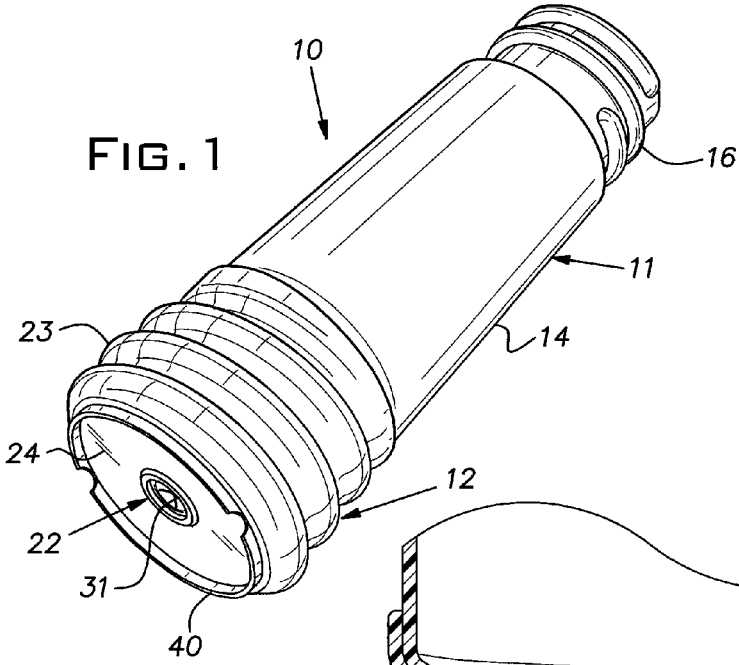
FIG. 1 is a perspective view of a bottom dispensing package in the form of a squeeze bottle and removable closure cap.

A package 10, in the form of a bottom dispensing container, includes a bottle 11 and closure 12. The illustrated package 10 is suited for dispensing fluid materials including liquids, especially thick liquids, pastes, and flowable particulate solids. In particular, as will be apparent from the following discussion, the package 10 is especially suited for dispensing edible material for foodstuff. In normal use, the package 10 is oriented with the closure 12 situated on the lower part of the bottle, making it inverted from the usual orientation where a closure is on the upper part of the package.

The bottle 11 is preferably molded with a relatively thin wall, e.g. 1 mm of a suitable relatively soft resilient material such as low density polyethylene, so that it can be manually squeezed to dispense its content and it will return to its original non-squeezed configuration. Where the package 10 is intended to contain edible material for human consumption, low density polyethylene is a suitable choice of an approved thermoplastic material. Ideally, the bottle 11 has a large neck finish 13, being about the same as the diameter of a main cylindrical portion 14. For example, the neck finish 13 can be nominally 53 or 63 mm. This geometry makes the bottle 11 easy to grip and squeeze with one hand.

The bottle neck or finish 13 has helical threads 16 and, as shown, the opposite end of the bottle 11 can be provided with the same threads. Where desired, the bottle can be open at both ends, by duplicating the neck finish 13 at these ends, or the bottle 11 can be closed at one end. In the latter case, the threads 16 can be optionally used to store a solid or a non-dispensing closure.

The closure 12 is an assembly of a relatively rigid main body 21 and an elastomeric valve 22. The closure main body includes a cylindrical skirt 23, with an internal thread surface 25 complimentary to the bottle threads 16, and a circular end wall 24 molded as one piece. The closure body 21 can be molded of a known plastic material such as high density polyethylene or other suitable plastic material approved for use with food intended for human consumption. The closure body 21 can have a nominal wall thickness of about 1.8 to about 2.0 mm. The closure body 21 and bottle 11 are characterized by respective wall geometries that avoid respective interior spaces within relatively sharp inside corners of less than about ⅛". This geometry greatly facilitates cleaning and sanitizing the package.

Figure 2:
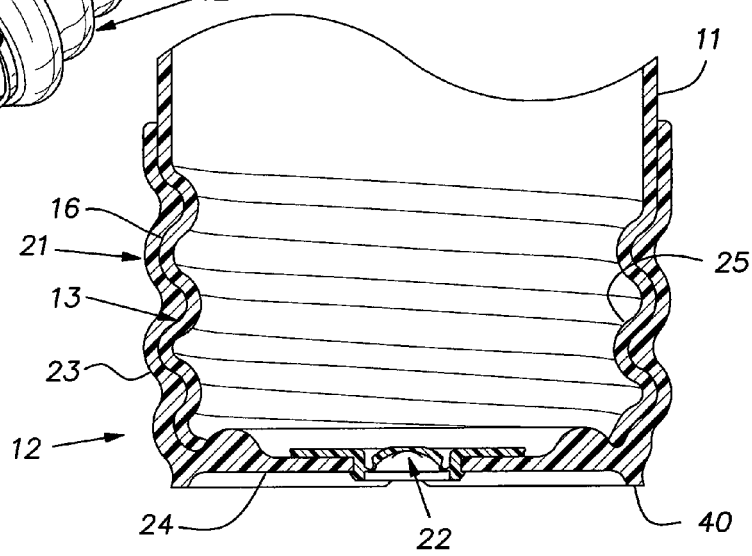
FIG. 2 is a cross-sectional view of a cap and a valve assembly constructed in accordance with the invention.
Figure 2A:
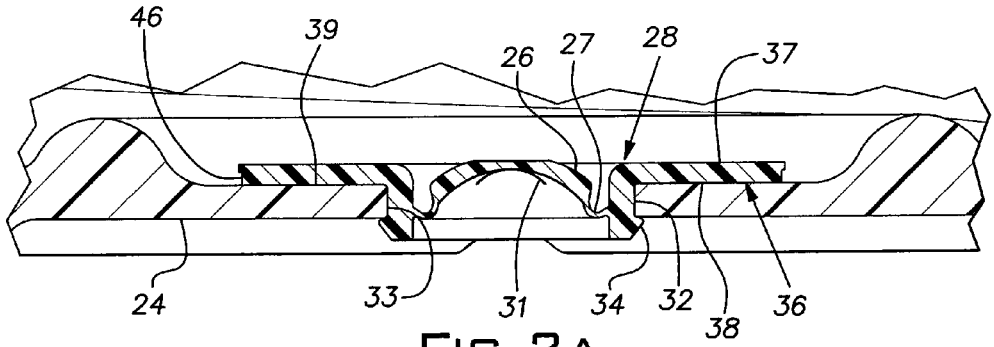
FIG. 2A is a fragmentary cross-sectional view of the cap and valve on an enlarged scale.

The illustrated valve 22 is similar to valves disclosed in aforementioned U.S. Pat. Nos. 5,213,236 and 5,409,144, for example, with an important distinction relating to its relationship with the closure end wall 24 on which it is mounted. The valve 22 can be molded of silicone rubber with a Shore hardness of 40 A or other elastomeric material suitable for the use to which the package 10 is to be put. The valve 22 is molded in one circular piece in essentially the cross-sectional configuration shown in FIG. 2. The valve 22 includes a circular head 26 surrounded by a connection sleeve 27 which in turn is surrounded by a base 28. The head 26 is provided with an orifice or dispensing slit 31, preferably in a cruciform configuration, as is customary, through which contents of the bottle 11 are discharged when the bottle 11 is squeezed to pressurize its contents. The connection sleeve 27 works as a rolling diaphragm in a manner described in the aforementioned patents.

The valve base 28 is concentric with the head 26 and sleeve 27. The base 28 includes a short cylindrical tubular wall 32 having an outside diameter and length sized to fit in a circular hole 33 formed in the center of the closure end wall 24. A lower end region of the cylindrical wall 32 is tapered or beveled radially from a diameter somewhat less than the end wall hole 33 to a small peripheral flange 34 with a diameter somewhat larger than this hole. The free outside diameter of the cylindrical wall 32 is preferably slightly larger than the diameter of the closure end wall hole 33. Extending radially outwardly of the cylindrical wall 32, the base 28 includes a flap seal 36. The flap seal 36 is preferably circular in plan view, and is relatively wide compared to its thickness. More particularly, the flap seal 36 extends radially from the cylindrical wall 32 to an outer periphery a distance that preferably is at least about five times and more preferably about at least seven times its average thickness. In the illustrated embodiment, the flap seal 36 has flat lower and upper surfaces 37, 38, respectively, that lie in parallel radial planes so that it has a generally uniform thickness across its radial extent.

With the valve 22 assembled on the closure body 21 such that the base wall 32 is received in the hole 33, the flange 34 lies outward of the end wall 24 and the flap seal 36 rests against and conforms to the inner surface 39 of the closure end wall 24. The valve 22 is retained on the end wall 24 solely by the physical interference between these parts either by radial plug fit between the circular wall 32 and bore 33 or by axial capture of the end wall between the flange 34 and flap seal 36 or both these plug fit and axial capture actions. A rim 40 of the closure 12 depends from the end wall 24 a distance sufficient to keep the valve flange 34 out of contact with any flat surface on which the package 10 is placed. The static pressure of fluid contents of the bottle 11 is effective on the upper surface 37 of the flap seal to seal the lower surface 38 on the inner surface 39 of the closure end wall 24. When the bottle 11 is squeezed and the contents are pressurized above atmospheric pressure, this pressure is applied directly to the flap seal 36 in direct proportion to the level of pressurization thereby compensating for the increased pressure so as to reduce the potential for leakage. The valve slit 31 remains closed until the contents are pressurized above atmospheric pressure at which time the slit opens.

Figure 3:
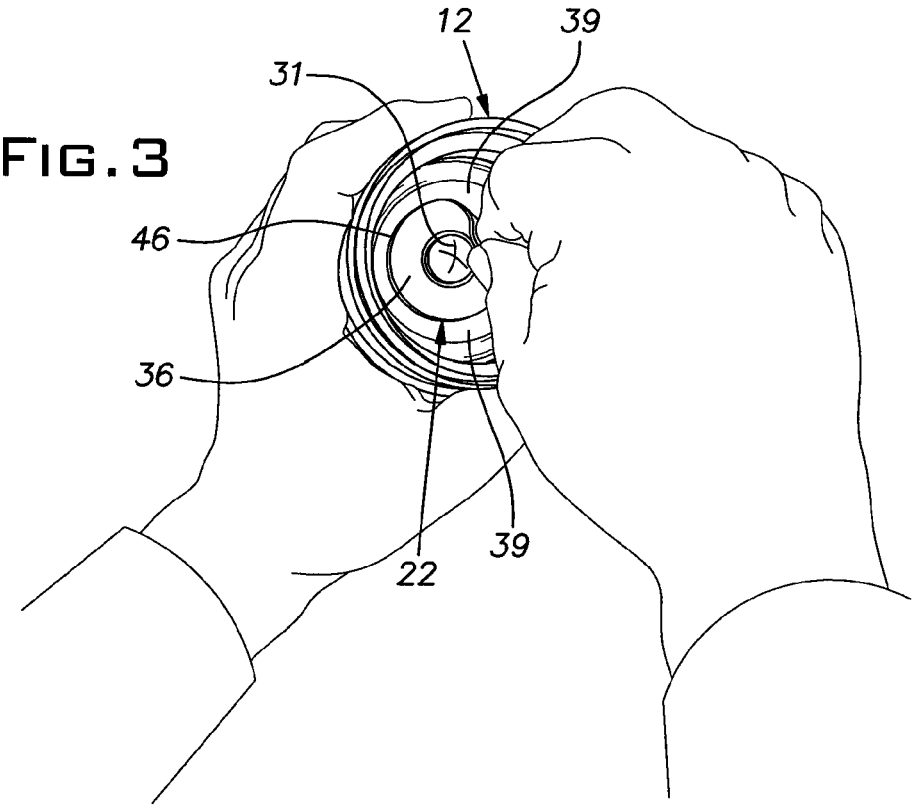
FIG. 3 is a perspective view of the inside of the cap demonstrating how the valve can be readily manually removed by gripping it from the inside of the cap.
Figure 4:
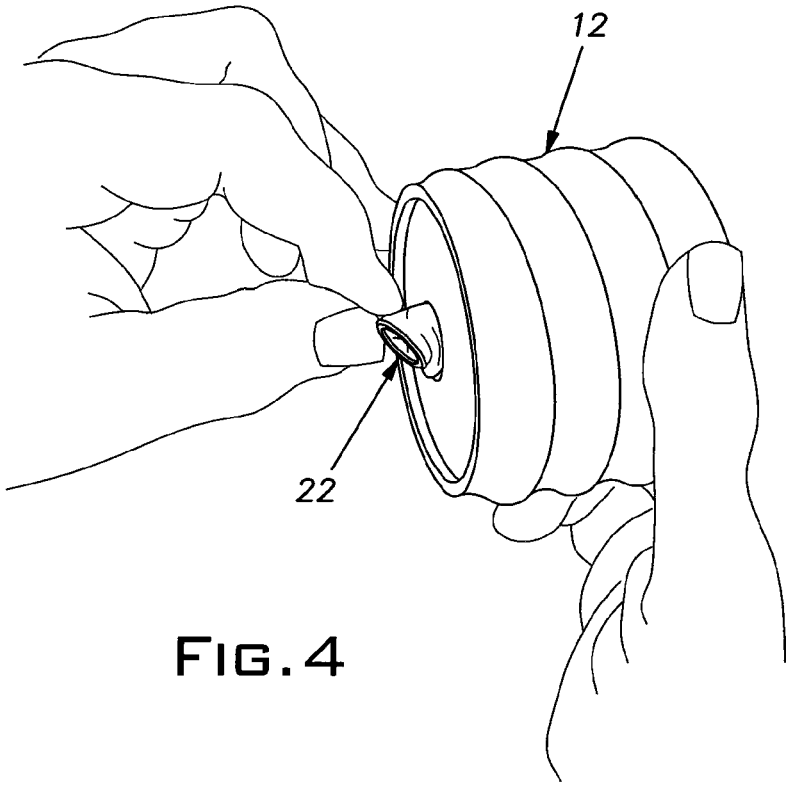
FIG. 4 is a perspective view of the outside of the cap demonstrating an alternative way of removing the valve from the cap.

The disclosed package 10 is well-suited for use in food service industries in such places as fast food restaurants and restaurant kitchens in general where fluid condiments including mustard, ketchup, sauces, salsas, salad dressings, etc., are used in the preparation of food servings. The convenience and efficiency of bottom dispensing packages in these and like applications are especially important. The invention represents an advance in refillable bottom dispensing packages such as the disclosed squeeze bottle and closure package. When a bottle is to be refilled with edible material, i.e. for human consumption, good sanitation practice dictates that it be completely purged of any residual of the previous contents. The interior contours of the bottle 11 and closure 12, being devoid of inside corners of a radius of less than about ⅛" make these parts easy to thoroughly clean since small crevices which would trap material and resist efforts to dislodge the same are non-existent. The valve 22 is readily removed from the closure 12 for purposes of cleaning these parts. The high flexibility of the valve 22 allows it to be removed from the hole 33 in either direction. When it is preferred to remove the valve 22 through the inside of the closure, the flap seal 36 can be lifted as shown in FIG. 3 to provide a finger grip on the flap seal by which the valve can be pulled through the interior of the closure 12. It will be seen that the perimeter, designated 46, of the flap seal 36 is spaced from the inside wall surface of the closure skirt 23 with enough room that a person can catch this part of the flap seal without a tool and lift it to get a secure finger grip on it as seen in FIG. 3 for purposes of removing the valve 22 from the closure 12. Alternatively, if preferred, the valve 22, as depicted in FIG. 4, can be removed by pushing it through the hole 33 by finger force applied, at least initially, against it from the interior of the closure 12. Since the valve 22 is highly flexible, it is relatively easy to clean even in its restricted areas. After cleaning, the valve 22 is easily reinstalled into the closure hole 33 by a simple pressing motion from the inside of the closure. Since the flap seal 36 abuts the inner surface 39 of the closure end wall 24 when the valve is properly seated, there is a clear tactile affirmation that the valve is properly installed. This proper installation can also be detected by a person by observing the uniform appearance of the small flange 34 on the outside of the closure end wall 24 at the perimeter of the hole 33.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A refillable bottom dispensing package forming a closed space in which contents of fluid material can be stored and from which the contents can be dispensed, the package having a rigid wall adjacent a bottom thereof, the wall having a hole, a resilient valve regulating dispensing of the fluid material contained in the package through the hole, the valve being closed to passage of the contents through the hole when the contents of the package is substantially at atmospheric pressure and being opened by pressure on the contents when said pressure is above atmospheric pressure, the valve forming a flap seal that seals against a substantially radial surface of said wall, the flap seal extending radially from the hole a distance several times an average thickness of the flap seal to a perimeter, a sealing action of the flap seal against said wall surface by mutual contact existing across substantially a full radial width of the flap and being free of influence from structural elements of the package while being directly responsive in sealing force against the wall surface to a pressure level of the contents in the package space, an inter-relationship of the flap seal and the wall within the package being arranged to avoid impeding removal of the valve from the wall and the package.

2. A bottom dispensing package as set forth in claim 1, wherein said valve is molded of an elastomeric material.

3. A bottom dispensing package as set forth in claim 1, wherein said valve is locally slit in a pattern, the slit pattern remaining essentially closed when the contents of the package are at near atmospheric pressure and open when the pressure in the package is increased above atmospheric pressure.

4. A refillable bottom dispensing package as set forth in claim 1, wherein said valve is molded of silicone with a Shore hardness of about 40 A.

5. A refillable bottom dispensing package as set forth in claim 1, wherein the flap seal is an annular substantially flat wall structure forming an outer periphery of said valve.

6. A refillable bottom dispensing package as set forth in claim 1, wherein said package comprises a squeeze bottle, and said wall is formed by a closure on a lower part of said bottle.

7. A refillable bottom dispensing package as set forth in claim 6, wherein said closure is threaded onto said bottle.

8. A refillable bottom dispensing package as set forth in claim 7, wherein internal surfaces of said bottle and closure are devoid of internal corners of a radius of substantially less than ⅛".

9. A bottom dispensing squeeze bottle and dispensing closure combination, the bottle being molded of a wall relatively soft resilient plastic with a threaded neck opening, the closure being releasably threaded onto the bottle neck and having a hole therethrough, a resilient pressure responsive valve attached to the closure by removably capturing the valve in the hole by virtue of a part of the valve being larger than the hole and being inserted in the hole, the valve including a relatively flap seal on the valve periphery adapted to seal on an interior surface of the closure surrounding the hole, the flap seal extending radially from the hole a distance several times an average thickness of the flap seal and being in contact with the interior surface of the closure across substantially a full radial extent of the flap seal.

10. A bottom dispensing squeeze bottle and dispensing closure combination as set forth in claim 9, wherein said valve has a slit formed orifice.

11. A bottom dispensing squeeze bottle and dispensing closure combination as set forth in claim 10, wherein the slit formed orifice is supported by a connector sleeve joined to said flap seal.

12. A valve for a bottom dispensing package comprising an elastomeric body molded as a single piece with a valve head, the valve head being slit to form a pressure responsive dispensing orifice, a connector sleeve connected at one end to a periphery of the valve head and at an opposite end connected to a circular mounting base, a flap seal above at least a portion of the mounting base and extending radially in a plane transverse to a direction of flow of fluid passing through the slit formed orifice, the flap seal being capable of sealing, in a free state, across substantially a full radial extent of the flap seal against a flat surface of a molded plastic surface, a width of the flap seal radially outward of the connector sleeve being at least as large as five times an average thickness of the flap seal.

13. A valve as set forth in claim 12, the circular mounting base including a cylindrical tubular portion disposed between said connector sleeve and said flap seal, said tubular portion being configured to fit in a hole in the wall against which said flap seal seals.

14. A valve as set forth in claim 13, wherein said cylindrical tubular portion distal from said flap seal has a peripheral flange larger in diameter than an outside diameter of said cylindrical tubular portion.

* * * * *